United States Patent [19]

Gardner

[11] 4,081,106

[45] Mar. 28, 1978

[54] RESEALABLE CONTAINER DEVICE

[75] Inventor: Roland C. Gardner, Doylestown, Pa.

[73] Assignee: Clevepak Corporation, New York, N.Y.

[21] Appl. No.: 662,686

[22] Filed: Mar. 1, 1976

[51] Int. Cl.[2] ..... B65D 41/00

[52] U.S. Cl. ..... 220/359; 215/341

[58] Field of Search ..... 220/359, 90.2, 90.6, 220/90.4; 215/341

[56] References Cited

U.S. PATENT DOCUMENTS

| | | | |
|---|---|---|---|
| 3,391,847 | 7/1968 | Christine | 220/359 |
| 3,767,076 | 10/1973 | Kennedy | 215/341 |
| 3,892,351 | 7/1975 | Johnson | 220/359 |

*Primary Examiner*—Ro E. Hart

*Attorney, Agent, or Firm*—Cushman, Darby & Cushman

[57] ABSTRACT

A resealable container device wherein the internal walls of the container device have a protective coating adhered thereon with a release coating on top thereof and a separate flexible protective end closure member adhered to the release coating so that removal of the end closure member leaves the protective coating intact and adhered to the inner walls of the container device; and a further cover member engageable with offset portions of the upper end of the container device so that the container may be resealed with the cover member once the protective end closure member is removed.

6 Claims, 3 Drawing Figures

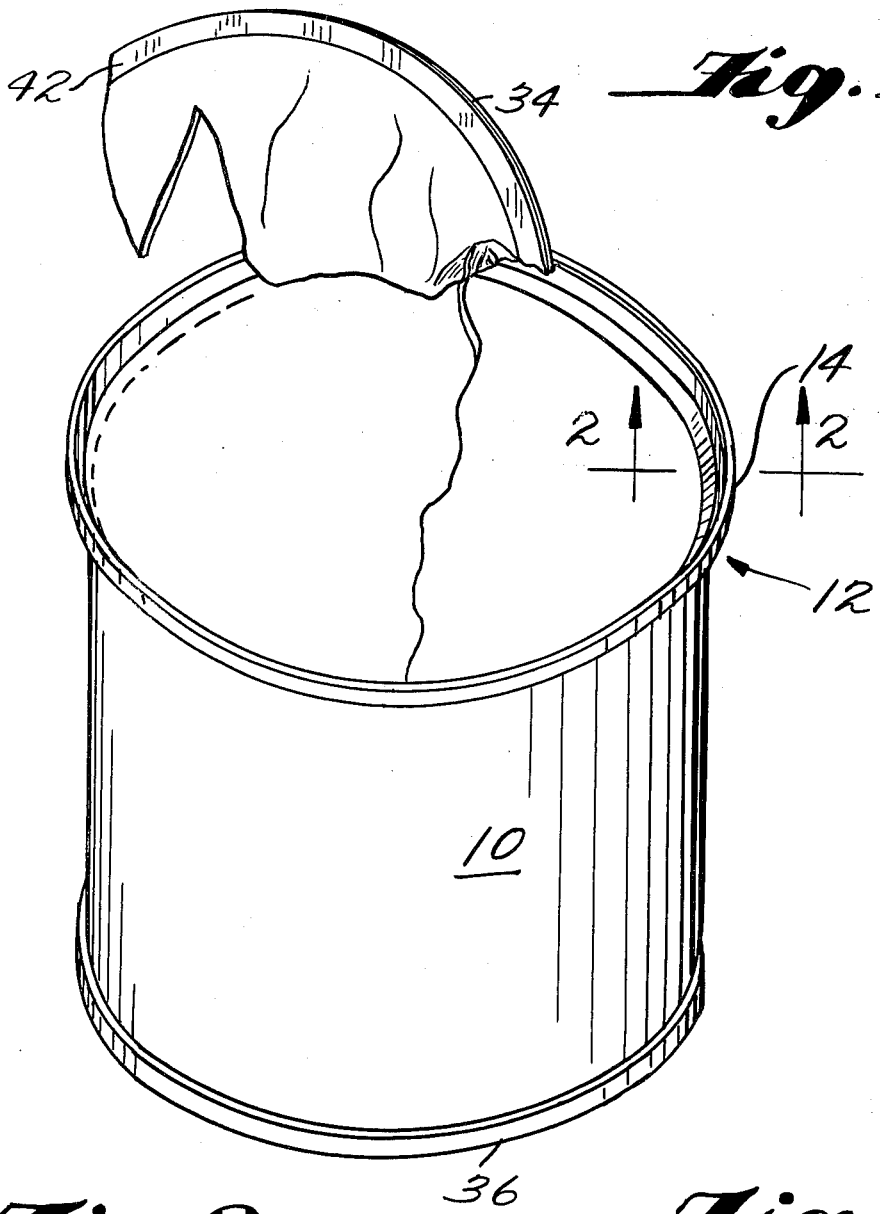
Fig. 1.
Fig. 2.
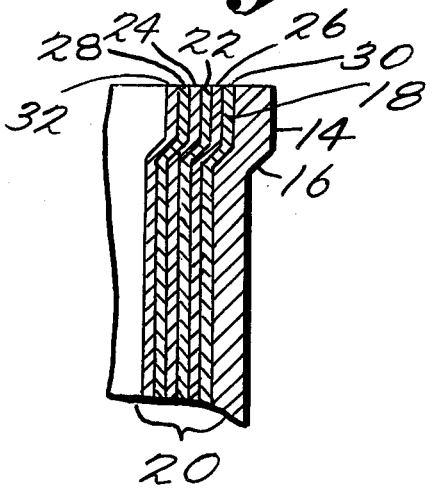
Fig. 3.
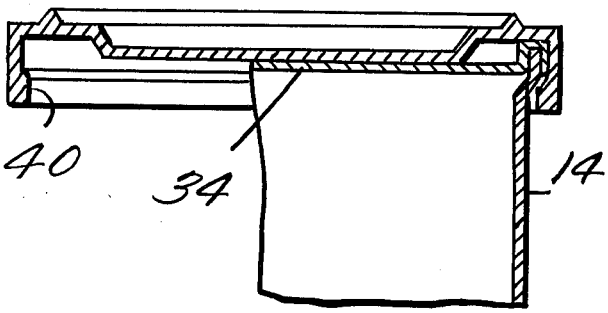

RESEALABLE CONTAINER DEVICE

BACKGROUND OF THE INVENTION

1. Field of the Invention

This invention relates to container devices, and more particularly to resealable container devices having a separate flexible internal sealing closure member which is removed before use.

2. Prior Art

Prior art container devices which utilize a foil seal on the internal walls of the container for providing a protective coating and keeping the material from which the walls are made, such as cardboard or other paper pulp material from contacting the food and possibly contaminating it due to moisture, etc., suffer from a common deficiency in that when a releasable closure member is securably adhered to the upper end portion of the device in order to close it, removal of it results in a tearing away of the foil on either the wall or the closure member which produces a ragged edge around the container device and permits pieces of foil to tear loose and contaminate the contents of the device. Many solutions have been proposed particularly in the way of various adhesives which are intended to permit an easier release of the flexible end closure member from the foil on the walls of the container, but these alternatives have proven to be unsatisfactory and have not solved the problem.

SUMMARY OF THE INVENTION

The present invention overcomes the above-described disadvantages and difficulties associated with prior art devices in that it provides a release coating over the surface of the protective coating which is normally a foil or other material covering the internal surfaces of the container, so that when the flexible foil end closure member is adhered to the release coating rather than the protective coating, the end closure member may easily be removed without tearing the foil on the closure member or removing the protective coating from the internal surfaces of the container, thus producing a beneficial result in that no aluminum pieces are permitted to drop into the container and contaminate the contents thereof, nor is a jagged or rough edge left on the container once the closure member is removed.

In addition, a resealable cover member is provided which in cooperation with an enlarged end portion of the device permits the cover member to sealingly engage the outer walls of the container so as to provide a resealable container once the internal end closure member is removed.

BRIEF DESCRIPTION OF THE DRAWINGS

FIG. 1 illustrates a perspective view of a container device embodying the invention;

FIG. 2 is a partial cross-sectional view along line 2—2 of the container device of FIG. 1, illustrating the structure of the wall portion thereof; and FIG. 3 is a partial cross-sectional view of the embodiment of FIG. 1 and additionally showing the resealable cover member.

DETAILED DESCRIPTION OF THE PREFERRED EMBODIMENT

In FIG. 1 is illustrated the cylindrical container device 10 which is usually constructed of a spirally wound cardboard material or other paper pulp type of material, often constructed in layers so that the outer surface thereof can have printed material or designs applied thereto. The preferred embodiment of the container of the present invention is illustrated as a cylindrical container device, however, it is to be understood that any shape of container device can utilize the advantages associated with the present invention, such as square or rectangular containers.

At the upper end portion 12 of the container device 10 is an outwardly offset upper portion 14 which provides a transition portion 16 in the side wall of the container device 10 which in conjunction with the cover member, to be described below, provides a resealable end portion of the container device.

On the inside wall 18 of the container device 10 is adhered a laminated film material coating 20 consisting of a plurality of layers of various thin films of material adhered together to form the film coating 20. This film coating 20 is adhered to the internal wall 18 by suitable adhesive material or by application of heat thereto, or other techniques which are well known in the art and are not considered part of this invention.

Although it is preferred that the film 20 is applied to the entire internal wall surfaces 18 of the container device, it is to be understood that it may be applied only to the upper portion of the container device 10 for reasons set out below.

The film coating 20 preferably consists of a laminate in which the central core portion 22 is made of a foil, such as a substantially aluminum alloy foil, adjacent layers 24 and 26 are preferably made of a cellophane base material and then further layers 28 and 30 of a polymer coating and then a final release layer 32, preferably on only the outer side of the film 20. The release layer 32 preferably consisting of a polymer material which will permit the layer to be pulled away from the remainder of the laminate film coating 20 without disturbing the remainder of the laminated film or pulling it away from the inner surface 18 of the container 10. A preferable material for use as the laminated member 20 is sold by the film division of Olin Corporation under the designation 103VF-58.

An alternative film which may be utilized as film 20 rather than that described above, is also marketed by the film division of Olin Corporation under the designation 112VH-58. This film differs from the above-described film in that the central core layer is made of high density polyethylene material and the adjacent layers are made of a cellophane base material with the subsequent or outer layers being made of a polymer material; with the release coating again being applied to only one surface of the laminated film so that it may be positioned on the inside of the container remote from the inner wall 18 of the container to provide a release material in the same way as mentioned above with the other laminate coating 20. The main distinction between the two materials being that the 122VH-58 is fully transparent while the 103VF-58 gives the appearance of a shiny aluminum foil; for purposes of the present invention, however, either lminated film would be satisfactory.

Referring again to FIG. 1, a flexible end closure member 34 is secured to the upper portion 14 of the device 10 before or after filling depending upon how the container is filled and sealed, for the purpose of providing an air tight and moisture tight seal on the upper portion of the container. The end closure member is preferably constructed of a flexible aluminum alloy foil. This end closure member may be applied to the upper end portion 14 of the container 10 by overlapping the foil as illustrated in FIG. 3, or it may be applied so as to abut the upper end portion of the portion 14 of the container and not overlap the side wall, in a manner which is not illustrated.

The bottom portion 36 of the container is closed with a rigid closure member such as a non-flexible aluminum alloy base plate applied to the container member in a conventional manner.

A top cover member 38 is also provided which is preferably made of an elastically deformable material which will generally retain its shape and is conventionally made of polymeric material. This cover member is so designed that it has a lower lip portion 40 which will engage the transition portion 16 of the upper end portion 14 of the container 10 when the cap is placed on the container and thus maintain the cover member 38 in sealing engagement with the upper end portion of the container member to maintain the product fresh and permit it to be reused and resealed as desired, once the closure member 34 has been initially removed.

When removing the end closure member 34 which is secured to the release coating 32 of the laminated film coating 20, the closure member is punctured and then removed, as illustrated in FIG. 1, so that a portion 42 of the release coating 32 will remain adhered to the closure member 34, when the closure member is removed. This leaves the remaining laminates of member 20 in position and prevents aluminum from either the protective aluminum coating 22 adhered to the inner walls of the container 10 or aluminum from the closure member 34, from being torn off and contaminating the contents of the container device. As was mentioned above, the film coating 20 or at least the release portion thereof, need not be applied to the complete inside walls of the container. It can be applied to only the top portion 14 where the end closure member 34 is adhered since this is the only area in which the possibility of removing aluminum foil from the inside of the container exists.

Although the foregoing descripton illustrates the preferred embodiment of the present invention, it will be apparent to those skilled in the art that variations are possible. All such variations as would be obvious to one skilled in this art are intended to be included within the scope of this invention as defined by the following claims.

What is claimed is:

1. In a container device wherein the internal walls of the container device have a protective coating adhered thereon and a separate flexible protective end closure member removably adhered to one end portion of the device to provide an opening in the device when the closure member is removed, the improvement comprising:

a release coating adhered over the protective coating on the side opposite the internal walls of the container device, the end closure member being adhered to the release coating, so that removal of the end closure member leaves the protective coating intact and adhered to the inner walls of the container device, and at least part of said release coating is removed with said end closure member.

2. A container device as defined in claim 1 wherein the protective coating and the protective end closure member are aluminum alloy foil.

3. A container device as defined in claim 1 wherein the protective coating is a polyethylene material.

4. A container device having a bottom and side walls, a protective coating adhered to at least the upper end portions of internal portions of the side walls; a separate flexible protective end closure member removably adhered to the upper end portion of the device to provide a non-resealable opening in the device when the closure member is removed; a separate elastically deformable cover member releasably securable to the upper end portion of the device overly covering the closure member, for providing a resealable cover for the device once the end closure member has been removed; the side walls at the upper end portion of the device being outwardly offset so as to provide a discontinuity in the upper end portion of the device which mates with a corresponding lip portion on the cover member so that the cover member is releasably sealingly engaged with the upper end portion of the device, and release coating is adhered over the protective coating on the side opposite the internal walls of the container, the end closure member being adhered to the release coating, so that removal of the end closure member leaves the protective coating intact and adhered to the inner walls of the container device, and at least part of said release coating is removed with said end closure member.

5. A device as defined in claim 4 wherein the protective coating and the end closure member are aluminum alloy foil.

6. A device as defined in claim 4 wherein the protective coating is a polyethylene material.

* * * * *